US009638196B2

(12) United States Patent
Yoshida et al.

(10) Patent No.: US 9,638,196 B2
(45) Date of Patent: May 2, 2017

(54) COMPRESSOR

(71) Applicant: MITSUBISHI HEAVY INDUSTRIES COMPRESSORS CORPORATION, Tokyo (JP)

(72) Inventors: Satoru Yoshida, Hiroshima (JP); Toru Yoshimune, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 379 days.

(21) Appl. No.: 14/377,341

(22) PCT Filed: Jan. 18, 2013

(86) PCT No.: PCT/JP2013/050938
§ 371 (c)(1),
(2) Date: Aug. 7, 2014

(87) PCT Pub. No.: WO2013/125270
PCT Pub. Date: Aug. 29, 2013

(65) Prior Publication Data

US 2015/0369249 A1 Dec. 24, 2015

(30) Foreign Application Priority Data

Feb. 24, 2012 (JP) ..... 2012-038812

(51) Int. Cl.
*F04D 29/62* (2006.01)
*F04D 17/12* (2006.01)
(Continued)

(52) U.S. Cl.
CPC ..... *F04D 17/125* (2013.01); *F04D 29/083* (2013.01); *F04D 29/4206* (2013.01); *F04D 29/624* (2013.01)

(58) Field of Classification Search
CPC .. F04D 17/125; F04D 29/083; F04D 29/4206; F04D 29/624; F01D 25/28
See application file for complete search history.

(56) References Cited

U.S. PATENT DOCUMENTS 3,927,763 A 12/1975 Strub et al.
5,087,172 A 2/1992 Ferri et al.
(Continued)

FOREIGN PATENT DOCUMENTS

CN 101311549 11/2008
CN 102762872 10/2012
(Continued)

OTHER PUBLICATIONS

First Office Action issued Nov. 4, 2015 in Chinese Application No. 201380008695.1 (with English translation).
(Continued)

*Primary Examiner* — Richard Edgar
(74) *Attorney, Agent, or Firm* — Wenderoth, Lind & Ponack, L.L.P.

(57) ABSTRACT

A compressor comprises a casing, a bundle which is housed inside the casing, and an inner roller which is provided at a front of the bundle in the inserting direction and rolls on an inner circumferential surface of the casing, a sealing surface protruded from the inner circumferential surface toward an inner circumferential side of the casing in a radial direction, a recess which is provided on the inner circumferential surface and in which the inner roller is settled when the bundle is housed inside the casing, a sealing member provided on an outer circumferential surface of the bundle and abutting on the sealing surface of the casing when the bundle is housed inside the casing. An extension part extending the
(Continued)

sealing surface to a front side thereof in the insertion direction of the bundle is provided in the inner circumferential surface of the casing.

2 Claims, 3 Drawing Sheets

(51) Int. Cl.
*F04D 29/42* (2006.01)
*F04D 29/08* (2006.01)

(56) References Cited

U.S. PATENT DOCUMENTS

| | | | |
|---|---|---|---|
| 5,971,702 | A | 10/1999 | Afton et al. |
| 2012/0243982 | A1 | 9/2012 | Sasaki et al. |

FOREIGN PATENT DOCUMENTS

| | | |
|---|---|---|
| JP | 47-12527 | 6/1972 |
| JP | 2000-38988 | 2/2000 |
| JP | 2011-220307 | 11/2011 |
| JP | 2012-177331 | 9/2012 |

OTHER PUBLICATIONS

Notice of Allowance issued Apr. 7, 2015 in corresponding Japanese Application No. 2012-038812 (with English translation).
International Search Report issued Apr. 16, 2013 in corresponding International Application No. PCT/JP2013/050938.
Translation of Written Opinion of the International Searching Authority issued Apr. 16, 2013 in corresponding International Application No. PCT/JP2013/050938.

COMPRESSOR

TECHNICAL FIELD

The present invention relates to a vertical split type compressor.

Priority is claimed on Japanese Patent Application No. 2012-038812 filed Feb. 24, 2012, the contents of which are incorporated herein by reference.

BACKGROUND ART

A vertical split type compressor is known in which a bundle having a substantially cylindrical shape and housing a rotor, blades and the like, is capable of removable inserting in an axial direction into inside a casing having a substantially cylindrical shape. In this vertical split type compressor, when the bundle is inserted into inside the casing, in order to avoid that the bundle interferes with the inner circumferential surface of the casing, a left-and-right pair of inner rollers is provided at lower part in the vicinity of a front end of the bundle and a truck is provided to support a rear part of the bundle, and the bundle is inserted into the casing while correcting an inclination angle of the bundle so that the relative angular difference between the bundle and the casing becomes to a predetermined angular difference (For example, Patent Document 1).

In a case of the above compressor, a recess recessed outward in a radial direction from an inner circumferential wall surface is formed in the vicinity of a front end of a chamber of the casing. In a state in which the bundle is completely housed inside the casing, the positions of the recess and the inner rollers are overlapped in the axial direction and the inner rollers drop into the recess, and accordingly, the inner rollers are relieved from the load.

PRIOR ART DOCUMENTS

Patent Documents

[Patent Document 1] Japanese Unexamined Patent Application, First Publication No. 2011-220307

DISCLOSURE OF THE INVENTION

Problems to be Solved by the Invention

In the compressor described above, as shown in FIG. 5, a sealing member 40 such as O-ring is installed on an outer circumferential surface 2*a* of the bundle 2. When the inner roller 20 drops into the recess 80, the sealing member 40 is sandwiched between a seal surface 60 formed on an inner circumferential surface 3*a* of the casing 3 and the outer circumferential surface 2*a* of the bundle 2, is elastically deformed, and seals.

However, since the inner roller 20 drops into the recess 80 while the bundle 2 is displaced in the axial direction, the sealing member 40 described above is entrained on the inner circumferential surface 3*a* at a rear side of a sealing surface 60 in a bundle insertion direction before the sealing member 40 is settled at the proper position between the sealing surface 60 and the outer circumferential surface 2*a* of the bundle 2. In FIG. 5, a state immediately after the inner roller 20 has dropped from the sealing surface 60 is shown by a two-dot chain line. In a case where the opening 50 is formed in the vicinity of the rear side of the sealing surface 60, the sealing member 40 is caught by a corner of the opening 50, and there is a problem such that damages or breaks can occur on the sealing member 40.

The present invention provides a compressor which can be improved in reliability by preventing from the damages and breaks of the sealing member.

Means for Solving the Problem

A compressor in accordance with a first aspect of the present invention includes: a casing which has a cylindrical shape with bottom having an opening on a peripheral wall of the casing; a bundle which is housed inside the casing by inserting the bundle from an axial direction; and an inner roller which is provided at a front part of the bundle in the inserting direction and which is configured to roll on an inner circumferential surface of the casing in the axial direction. The casing includes: a sealing surface formed so as to protrude from the inner circumferential surface toward an inner circumferential side of the casing in a radial direction in the vicinity of a front edge of the opening in the insertion direction of the bundle, and a recess which is provided on the inner circumferential surface and in which the inner roller is settled in a state in which the bundle is housed inside the casing. The bundle includes: a sealing member which is provided on an outer circumferential surface of the bundle and abuts the sealing surface of the casing in the state in which the bundle is housed inside the casing. An extension part extending the sealing surface to a front side of the sealing surface in the insertion direction of the bundle is provided in the inner circumferential surface of the casing.

By configuring the compressor in accordance with the above first aspect, when the inner roller is settled in the recess in a state in which the bundle is housed into the casing, the sealing member abuts on the sealing surface and it is possible to deform the sealing member. In addition, during inserting the bundle into the casing, since the inner roller is in a state of rolling on the extension part extending the sealing surface until the sealing member passed through the opening, contacting of the sealing member with a corner of the opening can be prevented.

The compressor in accordance with a second aspect of the present invention is the compressor according to the first aspect, and when: "b" is defined as a distance in the axial direction from a bottom part of the casing to the opening; "e" is defined as a distance in the axial direction from the front surface of the bundle to the rear end part of the internal roller in the insertion direction; and "d" is defined as a distance in the axial direction from a rotation center of the inner roller to the seal member; a distance "c", which is defined as a distance in the axial direction from a front-side edge in the insertion direction of the extending part to the opening, may be set to satisfy the relation of "b"−"e">"c">"d".

By configuring the compressor in accordance with the above second aspect, since the sealing member is arranged in a front side of the opening in the insertion direction when the inner roller is settled in the recess, contact between the sealing member and a corner of the opening can be reliably prevented. In addition, a sealing surface is formed according to the arrangement of the sealing member of the bundle, the recess is suitably formed according to the arrangement of the inner roller and the extension part can be set in a suitable length corresponding to the position of the opening.

The compressor in accordance with a third aspect of the present invention is the compressor according to the first aspect or the second aspect, and when "a" is defined as the distance in the axial direction from the bottom part of the casing to a sealing planning point of the sealing surface and "g" is defined as the distance from the front surface of the bundle to the rotation center of the inner roller, the relation of "b">"c"+"e">"a" and "a">"d"+"g" may be satisfied.

By configuring the compressor in accordance with the above third aspect, depending on the relative position between the opening and the sealing surface in the axial direction, it is possible to optimize the size of the extension portion in the axial direction. In addition, the sealing member can be arranged on the sealing surface or on the extension part in the axial direction in a state in which the front surface of the bundle is in contact with the bottom of the casing.

Effects of the Invention

The reliability of the compressor according to the above aspect of the present invention can be improved by preventing damages and breaks of the sealing member when inserting the bundle into the casing.

EMBODIMENTS OF THE INVENTION

Next, a compressor in an embodiment of the present invention will be described with reference to the drawings.

Figure 1:
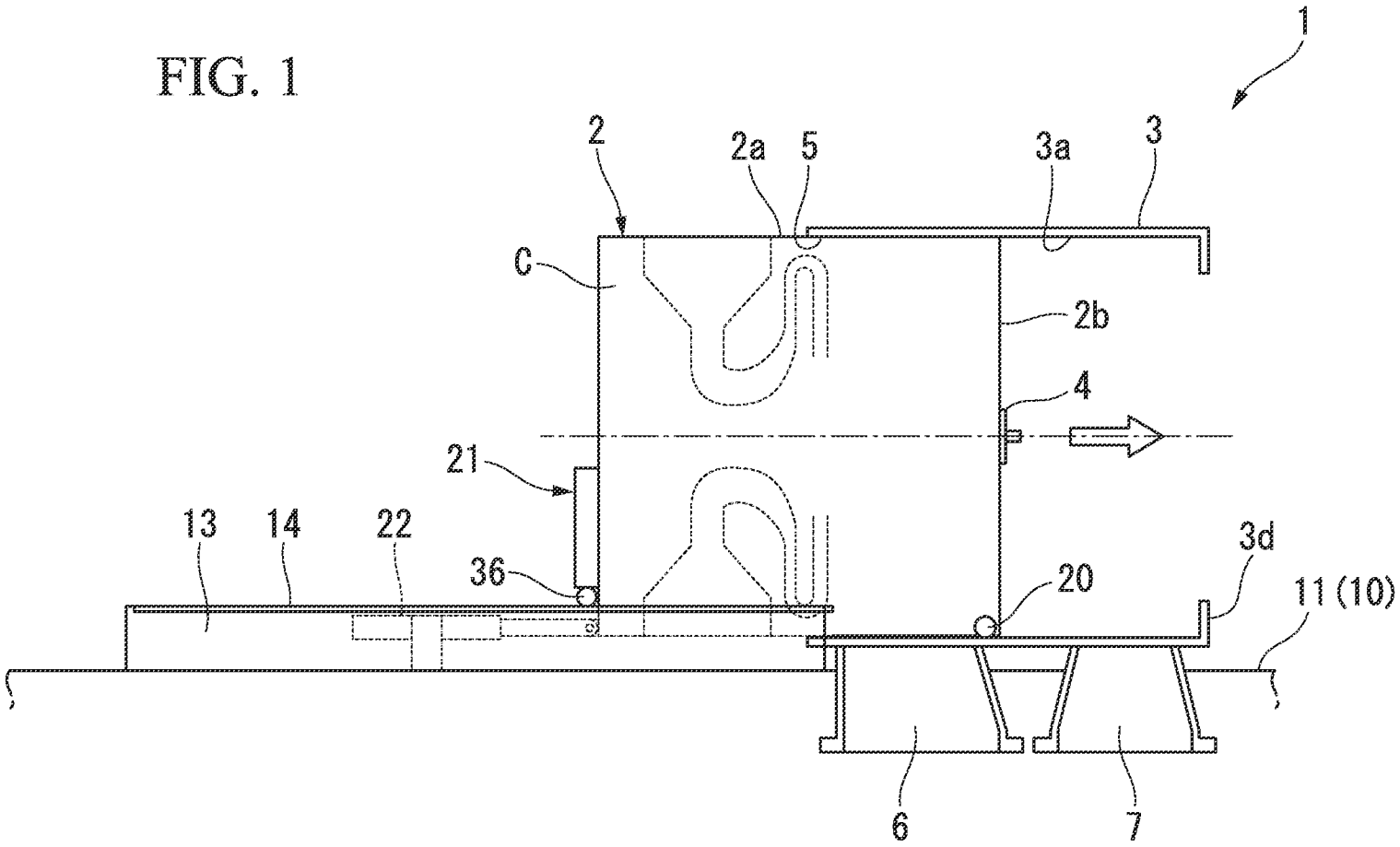
FIG. 1 is a configuration diagram showing a schematic configuration of a compressor in an embodiment of the present invention.

FIG. 1 is a configuration diagram showing a schematic configuration of a compressor in this embodiment.

As shown in FIG. 1, the compressor 1 is a vertical split type (barrel type) compressor, and the compressor includes mainly a bundle 2 having a cylindrical shape and provided with a static part C rotatably supporting the rotor 4 along with housing a rotor 4 and the like inside thereof, and a casing 3 having a substantially cylindrical shape with a bottom.

The casing 3 is capable of housing the bundle 2 inside thereof, and a diameter of an inner circumferential surface 3*a* of the casing 3 is slightly larger than a diameter of an outer circumferential surface 2*a* of the bundle 2 (for example, in an extent of several mm). The casing 3 is fixed on a horizontal base surface 11 of a foundation 10 so that an axial direction of the casing 3 faces a horizontal direction.

In the casing 3, in one side of the axial direction, an axial-direction opening 5 is formed in order to removably insert the bundle 2. Furthermore, a suction nozzle 6 opened such that its diameter increases downward and a discharge nozzle 7 are mounted in parallel in the axial direction respectively on the casing 3.

The foundation 10 is provided at downward of the casing 3 and extended along the axis line in a direction separating from the axial-direction opening 5. A right-and-left pair of rail members 13 is extended along the axis line in a direction separating from the axial-direction opening 5 of the casing 3 on the base surface 11 of the foundation 10. The rail members 13 are configured so that the upper surface 14 thereof is a horizontal surface and are arranged in parallel in substantially the same interval with the diameter of the bundle 2. In addition, a pair of inner rail members (not shown) having an inclination surface facing an outer circumferential surface 2*a* of the bundle 2 is extended in the inner track of the pair of the rail members 13.

The bundle 2 is provided with the inner roller 20 being capable of traveling along the axial direction of the bundle 2 in a front part thereof in its insertion direction (a direction shown with an arrow in FIG. 1), more specifically, in a lower part in the vicinity of a front surface 2*b* of the outer circumferential surface 2*a*. The inner roller 20 is capable of rolling on the inner circumferential surface 3*a* of the casing 3. The front part of the bundle 2 can be smoothly pushed into a bottom part 3*d* side of the casing 3 by the rolling of the inner roller 20, when the bundle 2 is inserted into the casing 3. On the other hand, when the bundle 2 is removed from the casing 3, the front part of the bundle 2 can be smoothly pulled out to the axial-direction opening 5 of the casing 3 by rolling of the inner roller 20. The inner roller 20 can travel on the inclination surface of the inner rail members described above and along the inner rail members.

A rear-part-traveling mechanism 21 which is capable of traveling on the upper surface 14 of the rail members 13 is installed in the rear part of the insertion direction in the bundle 2. The rear-part-traveling mechanism 21 has an outer roller 36 at a lower end part thereof to support the rear part of the bundle so as to be capable of sliding the rear part of the bundle 2 in the insertion direction. The outer roller 36 rolls on the upper surface 14 of the rail members 13 in the insertion direction.

A hydraulic cylinder 22 is installed on the foundation 10 along the rail members 13. When housing the bundle 2 inside the casing 3, the bundle 2 can be pushed toward an extending direction of the rail members 13 by the hydraulic cylinder 22. Furthermore, when removing the bundle 2 from the casing 3, the bundle 2 can be pulled out in the extending direction of the rail members 13.

Figure 2:
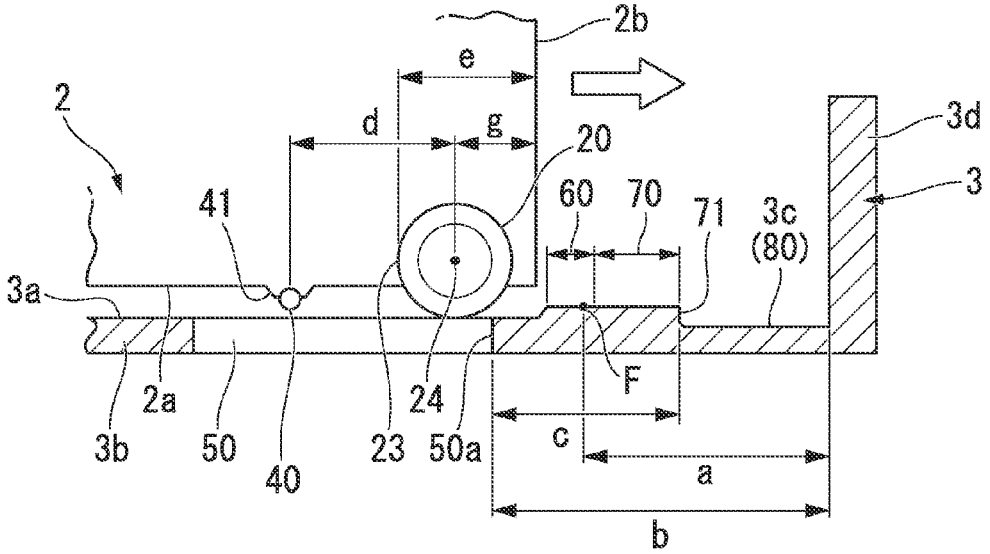
FIG. 2 is an enlarged cross-sectional view showing a front part of a bundle in the above compressor.

As shown in FIG. 2, the inner roller 20 is installed at the lower part of the bundle 2 in the front side (right side in FIG. 2) thereof in the bundle insertion direction. On the outer circumferential surface 2*a* of the bundle 2, a sealing member 40 such as an O-ring is provided in a state of extending in a circumferential direction in the rear side of the inner roller 20 in the bundle insertion direction. This sealing member 40 is mounted on a mounting seat 41 slightly protruding to the outer circumferential side in a radial direction from the outer circumferential surface 2*a* of bundle 2. This sealing member 40 is deformed by abutting a sealing surface 60 described later and seals the front part of the bundle 2 in a state in which the bundle 2 is housed inside the casing 3.

On the other hand, an opening 50 which communicates the inside of the casing 3 and the outside thereof is formed at a lower part of the peripheral wall 3*b* of the casing 3. This opening 50 is arranged inside the width direction of a pair of the tracks which the inner roller 20 rolls, and a nozzle, which is not shown, or the like, is connected to the outside.

In the vicinity of the front side of a front edge part 50*a* of the opening 50 in the bundle insertion direction, a sealing surface 60 for abutting the sealing member 40 described above is formed. The sealing surface 60 is extended to the circumferential direction of the inner circumferential surface 3*a* of the casing 3 and is protruded in a predetermined height on the inner circumference in the radial direction. The sealing surface 60 is formed on a surface substantially parallel to the outer circumferential surface 2*a* of the bundle 2, which is in a state of being housed in the casing 3. The height of the sealing surface 60 is set depending on the size of the gap between the inner circumferential surface 3*a* of the casing 3 and the bundle 2.

The extension part 70 is formed on the inner circumferential surface 3*a* of the casing 3. The extension part 70 is formed by extending the seal surface 60 in a predetermined length to a front side thereof in the bundle insertion direction. The extension part 70 is formed flush with respect to the sealing surface 60.

Further, in the casing 3, a recess 80 in which the inner roller 20 is settled when the bundle 2 is in a state of being housed completely in the casing 3 is formed in a front side of the extending part 70 in the bundle insertion direction. The recess 80 is provided with a circumferential surface 3*c* disposed further in the outer circumferential side of the inner circumferential surface 3*a* of the casing 3 in radial direction. On the front side of the recess 80, that is, on the front-most side of the casing 3 in the bundle insertion direction, a bottom part 3*d* which extends substantially perpendicular to the inner circumferential surface 3*a* of the casing 3 is formed.

The compressor 1 of this embodiment includes the above-described configuration, and next, a specific arrangement of each part in the bundle 2 and the casing 3 of the compressor 1 described above is explained.

As shown in FIG. 2, when: "b" is defined as a distance in the axial direction from the bottom part 3*d* of the casing 3 to the front edge part 50*a* of the opening 50; "e" is defined as a distance in the axial direction from the front surface 2*b* of the bundle 2 to the rear end part 23 of the inner roller 20 in the insertion direction; "d" is defined as a distance in the axial direction from the rotation center 24 of the inner roller 20 to the seal member 40; and "c" is defined as a distance in the axial direction from an edge 71 in a front side of the extending part 70 in the insertion direction to the front edge part 50*a* of the opening 50, the distance "c" is set so as to satisfy the relation of "b"−"e">"c">"d".

Here, the diameter of the inner roller 20 is determined according to the weight of the bundle 2. In addition, when the gas seal (not shown) is provided inside of the bundle 2 described above, the hole for the gas seal connected to the gas seal is disposed in a front side of the seal member 40 in the axial direction of the bundle 2. In this case, according to the arrangement of the hole for the gas seal and the diameter of the inner roller 20 or the like, the distance "b" and the distance "a" described later are determined.

By setting each part as described above, when the bundle 2 is in a state of being housed in the casing 3, the edge 71 on a front side of the extension part 70 is arranged in a position rearward in the bundle insertion direction from the position of the rear end part 23 of the inner roller 20 in the axial direction. Furthermore, when the inner roller 20 drops into the recess 80 from the extension part 70 and is settled in the recess 80, that is, when the rotation center 24 of the inner roller 20 is positioned at a position of the edge 71 on a front side of the extension part 70, the sealing member 40 is arranged in a front side of the front edge part 50*a* of the opening 50 in the bundle insertion direction.

In addition, when "a" is defined as the distance in the axial direction from the bottom part 3*d* of the casing 3 to a sealing planning point "F" of the sealing surface 60 and "g" is defined as the distance from the front surface 2*b* of the bundle 2 to the rotation center 24 of the inner roller 20, the relation of "b">"c"+"e">"a" and "a">"d"+"g" are satisfied. According to this configuration, in a state in which the inner roller 20 is completely settled inside the recess 80, the sealing member 40 can be arranged in a front side of the front edge part 50*a* of the opening 50, and when the front surface 2*b* is in a state of contacting with the bottom part 3*d*, the inner roller 20 can reliably be settled in the recess 80. The sealing planning point "F" is a planning position which the sealing member 40 abuts in the state in which the bundle 2 is housed in the casing 3.

Next, an operation when the bundle 2 of the compressor 1 is inserted into the casing 3 will be described with reference to the drawings.

As shown in FIG. 2, the bundle 2 is inserted into the casing 3 while rolling the inner roller 20 to the front side of the bundle insertion direction on the inner circumferential surface 3*a* of the casing 3. In this case, the sealing member 40 becomes in a state of separating from the inner circumferential surface 3*a* of the casing 3.

Figure 3:
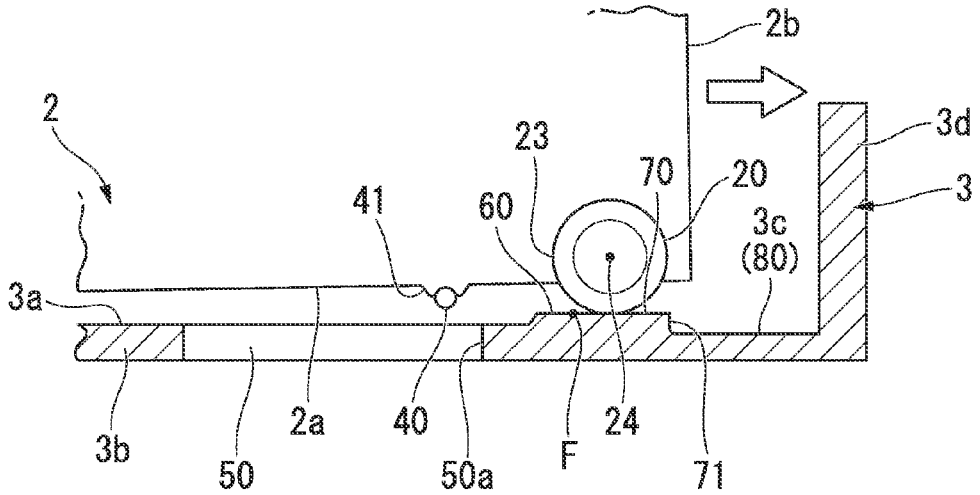
FIG. 3 is an enlarged cross-sectional view corresponding to FIG. 2 and showing a state in which an inner roller rolls on an extending part.

As shown in FIG. 3, when the bundle 2 is further displaced in the insertion direction, the inner roller 20 moves onto the sealing surface 60 while the inner roller 20 rolling. In this case, the sealing member 40 becomes in a state of separating from the inner circumferential surface 3*a* more than when the inner roller 20 moved onto the sealing surface 60.

Figure 4:
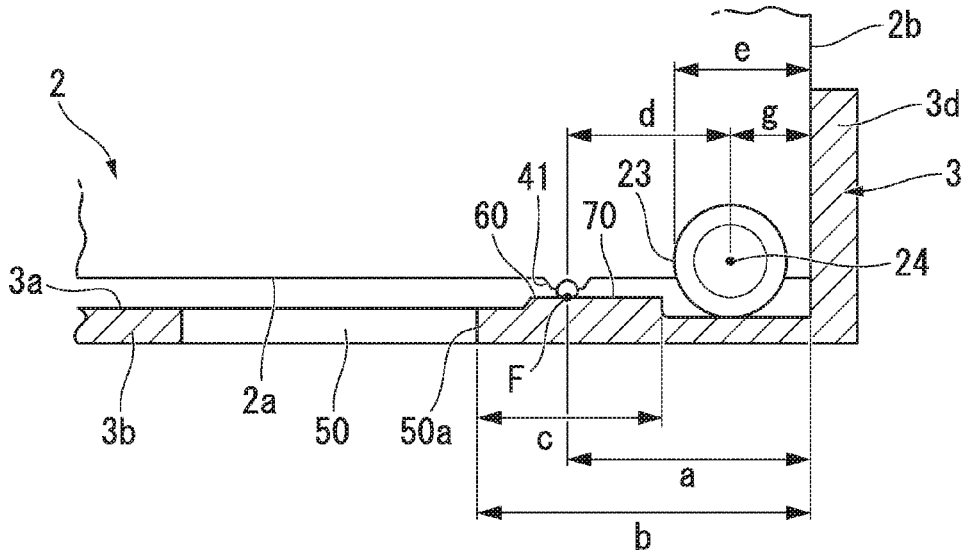
FIG. 4 is an enlarged cross-sectional view corresponding to FIG. 2 and showing a state in which an inner roller is settled in a recess.
Figure 5:
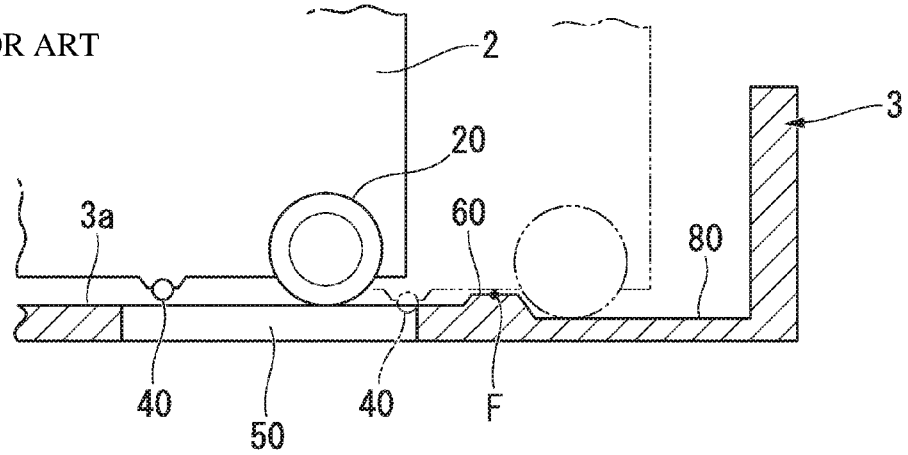
FIG. 5 PRIOR ART
FIG. 5 is a part enlarged view corresponding to FIG. 2 in a general compressor.

Then, when the inner roller 20 rolls from the sealing surface 60 to the extension part 70 in the bundle insertion direction and passes the edge 71 on a front side of the extension part 70, the inner roller 20 drops into the recess 80 from the extension part 70 and is settled in the recess 80. As shown in FIG. 4, when the front surface 2*b* of the bundle 2 is in contact with the bottom part 3*d* and the bundle 2 is in a state of being housed in the casing 3, the sealing member 40 abuts on the sealing surface 60 and is elastically deformed. Thus, the part of the bundle 2 which is in forward of the sealing member 40 becomes in a sealing state by the sealing member 40 and the sealing surface 60.

Therefore, according to the compressor 1 of the present embodiment described above, since the inner roller 20 is settled in the recess 80 in a state in which the bundle 2 is housed in the casing 3, the sealing member 40 abuts the sealing surface 60 and it is possible to elastically deform the sealing member 40.

In addition, during inserting the bundle 2 into the casing 3, since the inner roller 20 is in a state of rolling on the extension part 70 extending the sealing surface 60 until the sealing member 40 passed through the opening 50, contact between the sealing member 40 and a corner of the opening 50 can be prevented. As the result, the present embodiment can be improved in reliability by preventing from the damages and breaks of sealing member 40.

In addition, since the sealing member 40 is arranged in a front side of the edge 71 of the opening 50 when the inner roller 20 is settled in the recess 80, contact between the sealing member 40 and a corner of the opening 50 can be reliably prevented.

In addition, since a sealing surface 60 is formed according to the arrangement of the sealing member 40 of the bundle 2, the recess 80 is suitably formed according to the arrangement of the inner roller 20 and the extension part 70 can be set in an suitable length corresponding to the position of the opening 50, the length in the axial direction of the casing 3 can be minimized.

Furthermore, depending on the relative position between the opening 50 and the sealing surface 60 in the axial direction, the size of the extension portion 70 in the axial direction can be optimized. In addition, since the sealing member 40 can be arranged on the sealing surface 60 or on the extension part 70 in the axial direction in a state in which the front surface 2*b* of the bundle 2 is in contact with the bottom 3*d* of the casing 3 (housing state), when the bundle 2 is in a housing state in which the bundle 2 is housed inside the casing 3, the sealing member 40 abuts on the sealing surface 60 or on the extension part 70 and it is possible to elastically deform the sealing member 40. As the result, sealing can be reliably achieved by the sealing member 40.

The present invention is not limited to the configuration of the embodiment described above, but design changes can be made without departing from the spirit thereof.

In the present embodiment described above, as an example, an O-ring is used as a sealing member 40, but it is not limited to an O-ring. For example, a metallic seal can be used as a sealing member 40.

FIELD OF INDUSTRIAL APPLICATION

The present invention can be widely applied to a vertical split type compressor.

DESCRIPTION OF REFERENCE SIGNS

2: Bundle
2*a*: Outer circumferential surface
3: Casing
3*a*: Inner circumferential surface
20: Inner roller
40: Sealing member
50: Opening
60: Sealing surface
70: Extension part
80: Recess
F: Sealing planning point

What is claimed is:

1. A compressor comprising:

a casing which has a cylindrical shape with bottom having an opening on a peripheral wall of the casing;

a bundle which is housed inside the casing by inserting the bundle from an axial direction; and an inner roller which is provided at a front part of the bundle in the inserting direction and which is configured to roll on an inner circumferential surface of the casing in the axial direction, wherein the casing comprises:

a sealing surface formed so as to protrude from the inner circumferential surface toward an inner circumferential side of the casing in a radial direction in the vicinity of a front edge of the opening in the insertion direction of the bundle, and a recess which is provided on the inner circumferential surface and in which the inner roller is settled in a state in which the bundle is housed inside the casing, wherein the bundle comprises:

a sealing member which is provided on an outer circumferential surface of the bundle and abuts the sealing surface of the casing in the state in which the bundle is housed inside the casing, wherein an extension part extending the sealing surface to a front side of the sealing surface in the insertion direction of the bundle is provided in the inner circumferential surface of the casing, and wherein when:

"b" is defined as a distance in the axial direction from a bottom part of the casing to the opening;

"e" is defined as a distance in the axial direction from the front surface of the bundle to the rear end part of the internal roller in the insertion direction; and "d" is defined as a distance in the axial direction from a rotation center of the inner roller to the seal member, a distance "c", which is defined as a distance in the axial direction from a front-side edge in the insertion direction of the extending part to the opening, is set to satisfy the relation of "b"-"e">"c">"d".

2. The compressor according to claim 1, wherein when "a" is defined as the distance in the axial direction from the bottom part of the casing to a sealing planning point of the sealing surface and "g" is defined as the distance from the front surface of the bundle to the rotation center of the inner roller, the relation of "b">"c"+"e">"a" and "a">"d"+"g" are satisfied.

* * * * *